US011066760B2

(12) United States Patent
Jakobinski et al.

(10) Patent No.: US 11,066,760 B2
(45) Date of Patent: Jul. 20, 2021

(54) OPEN-END SPINNING DEVICE

(71) Applicant: Saurer Spinning Solutions GmbH & Co. KG, Uebach-Palenberg (DE)

(72) Inventors: Andreas Jakobinski, Erkelenz (DE); Lothar Winzen, Herzogenrath (DE); Jakub Miodek, Moenchengladbach (DE)

(73) Assignee: Saurer Spinning Solutions GmbH & Co. KG, Uebach-Palenberg (DE)

( * ) Notice: Subject to any disclaimer, the term of this patent is extended or adjusted under 35 U.S.C. 154(b) by 0 days.

(21) Appl. No.: 16/059,330

(22) Filed: Aug. 9, 2018

(65) Prior Publication Data

US 2019/0048492 A1 Feb. 14, 2019

(30) Foreign Application Priority Data

Aug. 11, 2017 (DE) ..... 10 2017 118 390.6

(51) Int. Cl.
*D01H 4/08* (2006.01)

(52) U.S. Cl.
CPC ..... *D01H 4/08* (2013.01)

(58) Field of Classification Search
CPC .. D01H 1/08; D01H 1/14; D01H 4/08; D01H 4/10; D01H 4/12; D01H 4/14
See application file for complete search history.

(56) References Cited

U.S. PATENT DOCUMENTS 3,377,113 A * 4/1968 Wilson ..... F16C 17/045 310/90.5
4,076,340 A * 2/1978 Meinke ..... D01H 4/14 310/90.5
4,110,961 A * 9/1978 Havel ..... D01H 4/40 57/349
4,242,858 A * 1/1981 Dschen ..... D01H 4/08 57/415
4,242,860 A * 1/1981 Wehde ..... D01H 13/1633 340/664
4,565,064 A * 1/1986 Iwasaki ..... D01H 7/90 57/328
4,642,981 A * 2/1987 Shimano ..... D01H 7/92 57/333
5,414,990 A * 5/1995 Blazek ..... D01H 4/08 57/411

(Continued)

FOREIGN PATENT DOCUMENTS

DE 103 03 481 A1 7/2004

*Primary Examiner* — Shaun R Hurley
(74) *Attorney, Agent, or Firm* — Nelson Mullins Riley & Scarborough LLP

(57) ABSTRACT

An open-end spinning device having a rotor housing (1) which can be acted upon by negative pressure and a spinning rotor (2), the rotor housing (1) is open towards the front and can be closed by a cover element, to the rear the rotor housing (1) has a rear wall (3) with a passage opening (4) for a rotor shaft (5) of the spinning rotor (2). In order to prevent the occurrence of thread coils inside the rotor housing (1) behind the spinning rotor, a narrow gap (6) of less than 2 mm is provided between the spinning rotor (2) and the rear wall (3) of the rotor housing (1) at the largest outer diameter of the spinning rotor (2) and the rear wall (3) of the rotor housing (1) is designed such that the area (7) behind the spinning rotor (2) is covered inside the rotor housing (1).

8 Claims, 5 Drawing Sheets

(56) References Cited

U.S. PATENT DOCUMENTS

| | | | | | |
|---|---|---|---|---|---|
| 5,537,810 | A * | 7/1996 | Paweletz | D01H 4/12 | 57/100 |
| 5,637,941 | A * | 6/1997 | Paweletz | D01H 4/10 | 310/90.5 |
| 5,640,838 | A * | 6/1997 | Billner | D01H 4/50 | 57/263 |
| 5,717,264 | A * | 2/1998 | Hadano | D01H 1/244 | 310/75 D |
| 5,720,160 | A * | 2/1998 | Traxler | D01H 1/08 | 310/90.5 |
| 5,802,837 | A * | 9/1998 | Paweletz | D01H 4/14 | 384/446 |
| 6,573,628 | B1 * | 6/2003 | Sloupensky | D01H 4/14 | 310/90.5 |
| 7,181,901 | B2 * | 2/2007 | Riede | D01H 4/08 | 57/404 |
| 2004/0103635 | A1 * | 6/2004 | Weide | D01H 4/08 | 57/417 |
| 2004/0173970 | A1 * | 9/2004 | Stahlecker | D01H 4/08 | 277/358 |
| 2006/0225401 | A1 * | 10/2006 | Riede | D01H 4/08 | 57/404 |
| 2008/0124204 | A1 * | 5/2008 | Schuller | C04B 35/522 | 414/406 |

* cited by examiner

OPEN-END SPINNING DEVICE

CROSS-REFERENCE TO RELATED APPLICATIONS

This application claims the benefit of German patent application DE 10 2017 118 390.6, filed Aug. 11, 2017, herein incorporated by reference.

FIELD OF THE INVENTION

This invention concerns an open-end spinning device comprising a rotor housing which can be subjected to negative pressure, and a spinning rotor. The rotor housing is open towards the front and can be closed by a cover element. To the rear, the rotor housing has a rear wall with an opening for a rotor shaft of the spinning rotor. The rotor shaft is driven outside the rotor housing.

BACKGROUND OF THE INVENTION

An open-end spinning device comprises a rotor housing with a cover element for closing the rotor housing. A spinning rotor is arranged in the rotor housing. The spinning rotor is mounted in a pivoting arrangement. The spinning rotor can be driven for spinning in different ways. It has been disclosed that spinning rotors of several open-end spinning devices can be driven via a common drive. The force can be transmitted from the common drive to the spinning rotors, for example by means of a belt. It has also been disclosed that each spinning rotor can be assigned an individual electromotive drive. In combination with an individual drive, the spinning rotor is preferably mounted without contact. A non-contact bearing can be configured as a magnetic bearing. Contactlessly mounted spinning rotors with individual drives are particularly sensitive to contamination.

A vacuum is required in the rotor housing for spinning. Therefore, open-end rotor spinning machines of prior art have a central vacuum source and a machine-long vacuum line. The vacuum supply of the open-end spinning devices is provided by connecting the rotor housing to the machine-long vacuum line.

In spinning operation, fiber material is introduced into the rotor housing via a fiber guide channel and the finished spun yarn is drawn off from the rotor housing via a yarn draw-off channel. The spinning rotor end of the yarn draw-off channel is located at an end which is attached to the cover element and projects into the spinning rotor. When the fibers fed into the rotor are no longer transported out during the spinning process, fiber rings are formed. This can happen, for example, in the event of yarn breakage and, possibly, delayed shutdown of the sliver feed. First, the fibers are held in the rotor groove by the centrifugal forces. When the spinning rotor is braked, the fiber ring collapses and wraps around the projection protruding into the spinning rotor. From there, the fiber ring can get further behind the spinning rotor and form a fiber coil. Such a fiber coil can no longer be sucked out by the negative pressure in the rotor housing and it impairs the spinning result.

DE 103 03 481 A1 discloses an open-end spinning device with a spinning rotor consisting of rotor plate and rotor shaft, with a rotor housing surrounding the rotor plate and under negative pressure, which has a passage opening for the rotor shaft mounted outside the rotor housing, and with a sealing element which seals the passage opening, is arranged floating in the radial direction relative to the rotor shaft and forms a sealing gap with the rotor shaft and makes axial contact on the rotor housing. The sealing element is provided with an extension which surrounds a rear wall of the rotor plate facing the passage opening into the area of the largest outer diameter of the rotor plate while leaving a narrow envelope gap. The air friction at the rotor plate should be markedly reduced by the extension surrounding the rotor plate. However, this arrangement cannot prevent a thread coil from forming inside the rotor housing behind the spinning rotor or more precisely behind the rotor plate.

SUMMARY OF THE INVENTION

An object of the present invention is prevention of the occurrence of thread coils inside a rotor housing behind a spinning rotor.

The present invention provides a proposed solution to the problem. Briefly summarized, the present invention involves an open-end spinning device comprising a rotor housing which can be subjected to negative pressure and a spinning rotor. The rotor housing is open towards the front and can be closed by a cover element, to the rear the rotor housing has a rear wall with a passage opening for a rotor shaft of the spinning rotor. At the largest outer diameter of the spinning rotor there is a narrow gap of less than 2 mm gap width between the spinning rotor and the rear wall of the rotor housing, and the rear wall of the rotor housing is designed in such a manner that the area behind the spinning rotor is covered inside the rotor housing.

Due to the design of the rear wall of the rotor housing according to the present invention, the area behind the spinning rotor is shielded inside the rotor housing so that fiber coils cannot reach it. This means that the rear wall of the rotor housing is designed in such a manner that there are no passages from the front into the area behind the spinning rotor. The only exception is the gap between the rear wall of the rotor housing and the largest outer diameter of the spinning rotor. However, if the gap width of less than 2 mm is maintained according to the present invention, the passage of fibers can be prevented as far as possible. The gap width should be greater than 0.2 mm to avoid contact between the spinning rotor and the rear wall. A gap width of 1 mm is preferred.

In addition to preventing fiber coils from getting behind the spinning rotor, the open-end spinning device according to the present invention has the advantage of low air friction. A rotor generates a turbulent flow due to its rotation, which leads to friction losses and thus to a higher power consumption of its drive. The embodiment of the rear wall of the rotor housing according to the present invention converts the turbulent flow into a laminar flow. The air flow is directed outwards. This results in a pressure gradient. Less air means less air friction and thus energy savings for the drive.

The spinning rotor has a rotor bottom facing the rear wall of the rotor housing. The narrow gap can continue at least partly along the rotor bottom. The gap width can change with the distance from the largest outer diameter. It is by no means necessary for the gap to continue to the rotor shaft. Behind the spinning rotor, it is by all means possible for there to be a cavity. The only essential factor for the invention is that the area behind the spinning rotor is shielded.

Preferably, the spinning rotor has an outer edge at the largest outer diameter and the narrow gap continues axially along the outer edge.

According to a preferred embodiment, the rear wall of the rotor housing is at least partially formed by an exchangeable attachment which rests on a boundary wall of the rotor housing. In this way, the rear wall of the rotor housing can be easily adapted to different shapes and diameters of the spinning rotor.

The attachment preferably forms the narrow gap at the largest outer diameter of the spinning rotor with the spinning rotor. The insert is preferably rotationally symmetrical and is arranged centrically to the spinning rotor. The attachment can be conical, with the diameter of the attachment increasing from front to rear. The attachment can also be cylindrical.

The attachment can be attached to a boundary wall of the rotor housing by means of a clip connection, a screw connection, a magnetic force or a press fit.

According to a preferred embodiment, the attachment extends to the side partition walls of the rotor housing. This makes it easy to attach. Clip or press connections can be easily implemented.

However, this invention can also be implemented without an attachment. Then the rear wall is formed by the rear boundary wall of the rotor housing.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The invention is explained in greater detail below on the basis of embodiment examples shown in the drawings.

The figures show open-end spinning devices according to the present invention. Since open-end spinning devices have already been disclosed in principle, the representation of the figures is limited to the essential elements of the invention. In the figures, elements with similar functions have the same reference numbers, even if the elements are designed differently.

DETAILED DESCRIPTION OF THE INVENTION

Figure 1:
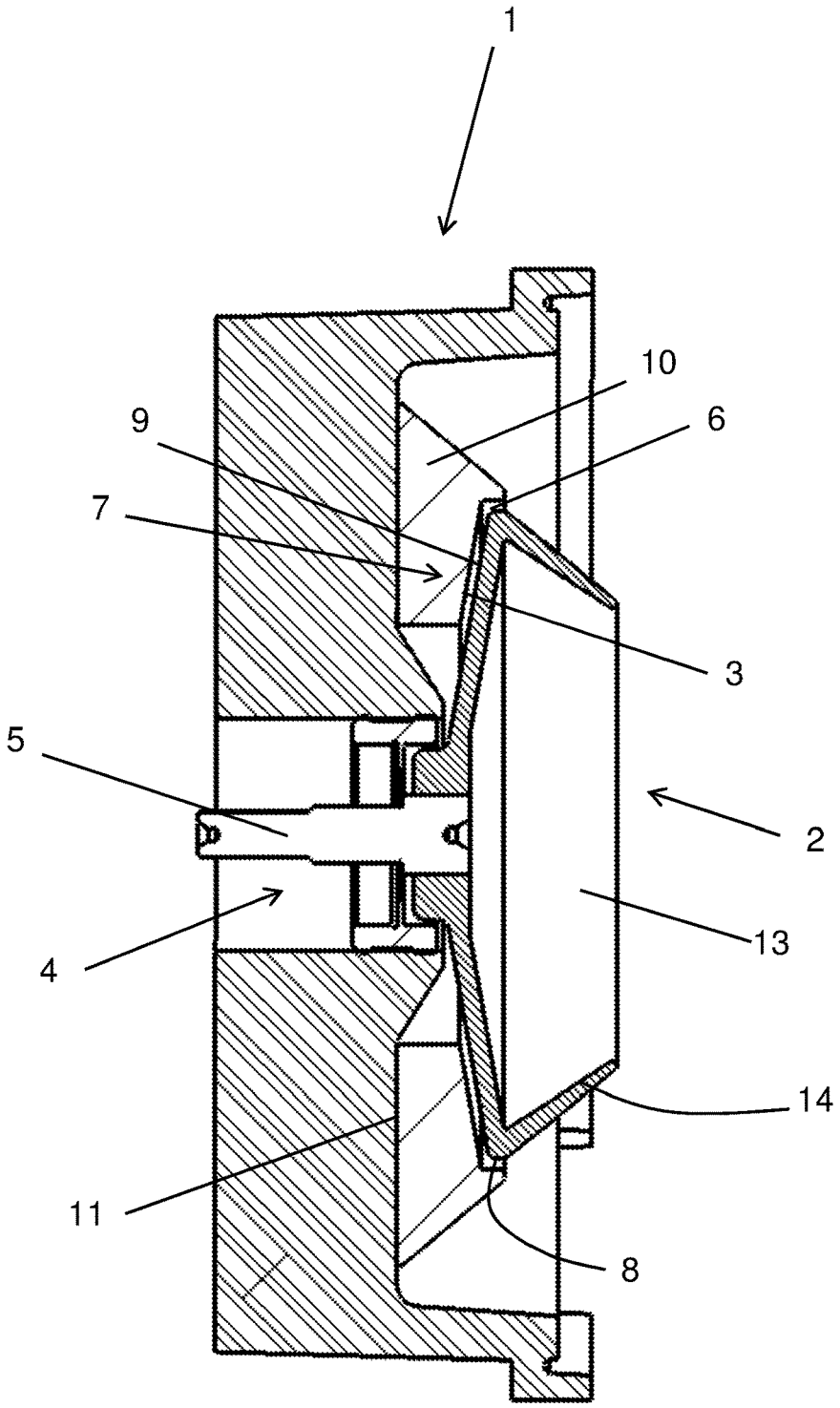
FIG. 1 shows an open-end spinning device according to the present invention with an exchangeable attachment.

FIG. 1 shows a first embodiment of an open-end spinning device according to the invention. This comprises a rotor housing 1 open to the front and a spinning rotor 2 arranged inside. In spinning operation, the rotor housing 1 is closed by a cover element that is not shown and is pressurized by a vacuum supply that is not shown. Away from the open side, i.e. towards the back, the rotor housing 1 has a passage opening 4 for a rotor shaft 5 of the spinning rotor 2. The rotor shaft 5 and thus the spinning rotor 2 are driven outside the rotor housing 1.

The rotationally symmetrical spinning rotor 2 comprises a rotor shaft 5 and a spinning cup 13. The spinning cup 13 comprises a rotor bottom 9 and a ring-shaped wall section 14. The ring-shaped wall section 14 is cone-shaped towards the open end. The largest outer diameter of the spinning rotor 2 is thus located at the transition area between the rotor bottom 9 and the ring-shaped wall section 14. The spinning rotor 2 shown has an outer edge of 8 at its largest outer diameter.

The embodiment of FIG. 1 has an attachment 10. The attachment 10 is mounted on the rear boundary wall 11 of the rotor housing 1. The rear wall 3 of the rotor housing 1 is thus partly formed by the attachment 10. The rear wall 3 of the rotor housing 1, in the shown embodiment example of attachment 10, covers the area 7 behind the spinning rotor 2. At the largest outer diameter of the spinning rotor 2, the attachment 10 and the spinning rotor form a narrow gap 6 with a gap width of less than 2 mm. The gap width results from the smallest distance of the largest outer diameter of the spinning rotor 2 from the rear wall 3 of the rotor housing 1. In the embodiment example, the gap 6 continues along the rotor bottom 9. The gap 6 also continues axially along the outer edge 8.

The rear wall 3 of the rotor housing 1 shields the area 7 behind the spinning rotor 2 inside the rotor housing 1. The rear wall 3 is designed in such a way that there is no opening along an imaginary jacket surface around the axis of rotation of the spinning rotor 2 due to the largest outer diameter of the spinning rotor, with the exception of the narrow gap between the spinning rotor 2 and the rear wall 3.

In the embodiment example shown in FIG. 1, the attachment 10 is conical. The diameter of the rotationally symmetrical attachment 10 increases from the spinning rotor 2 to the rear boundary wall 11. Attachment 10 can also be cylindrical.

Figure 2:
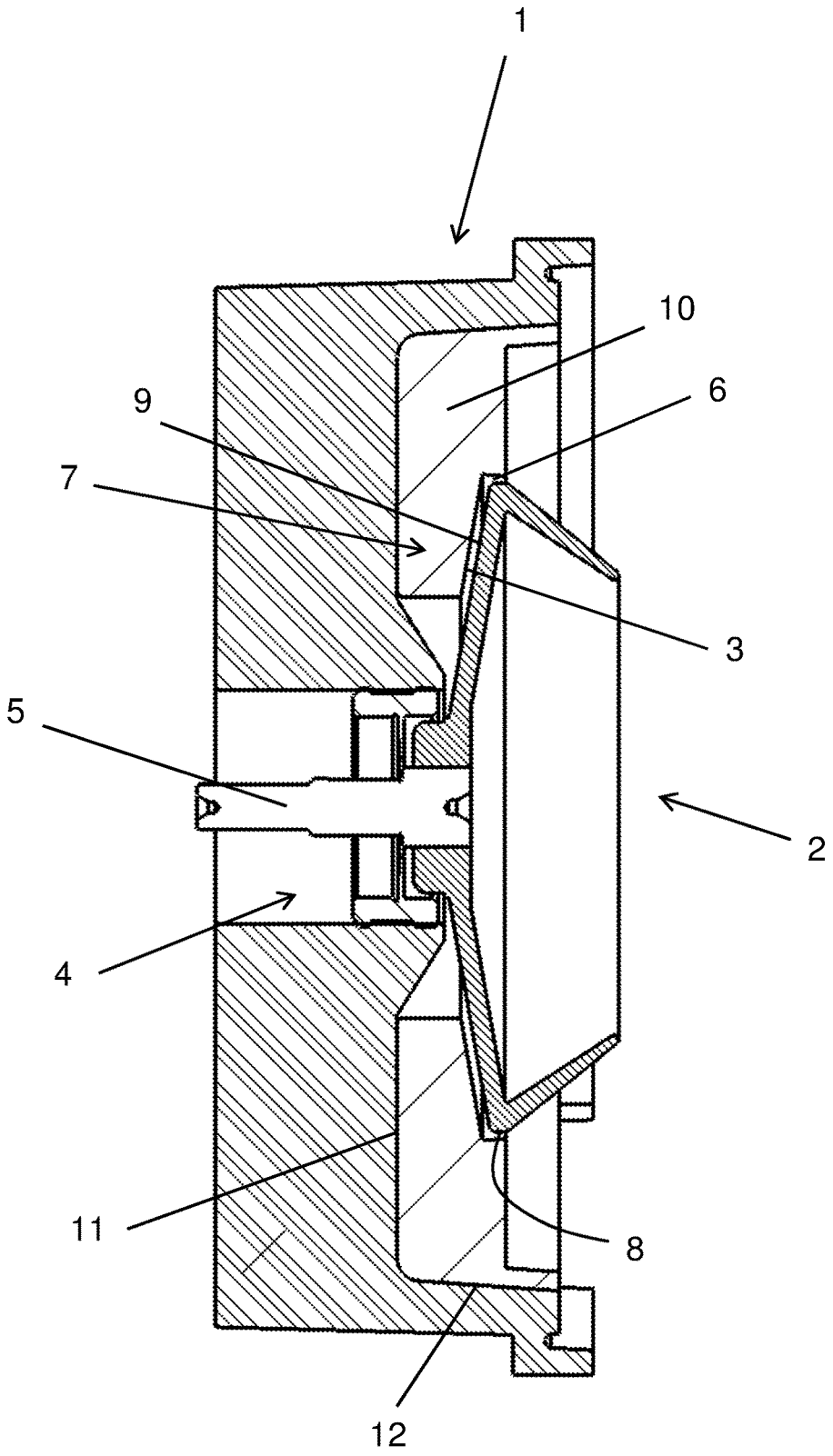
FIG. 2 shows an open-end spinning device according to the present invention with an alternative exchangeable attachment.

The open-end spinning device of FIG. 2 essentially corresponds to the open-end spinning device of FIG. 1. The only difference between the two spinning devices is the embodiment of attachment 10. The attachment 10 of FIG. 2 extends to the lateral boundary walls 12 of the rotor housing 1.

Figure 3:
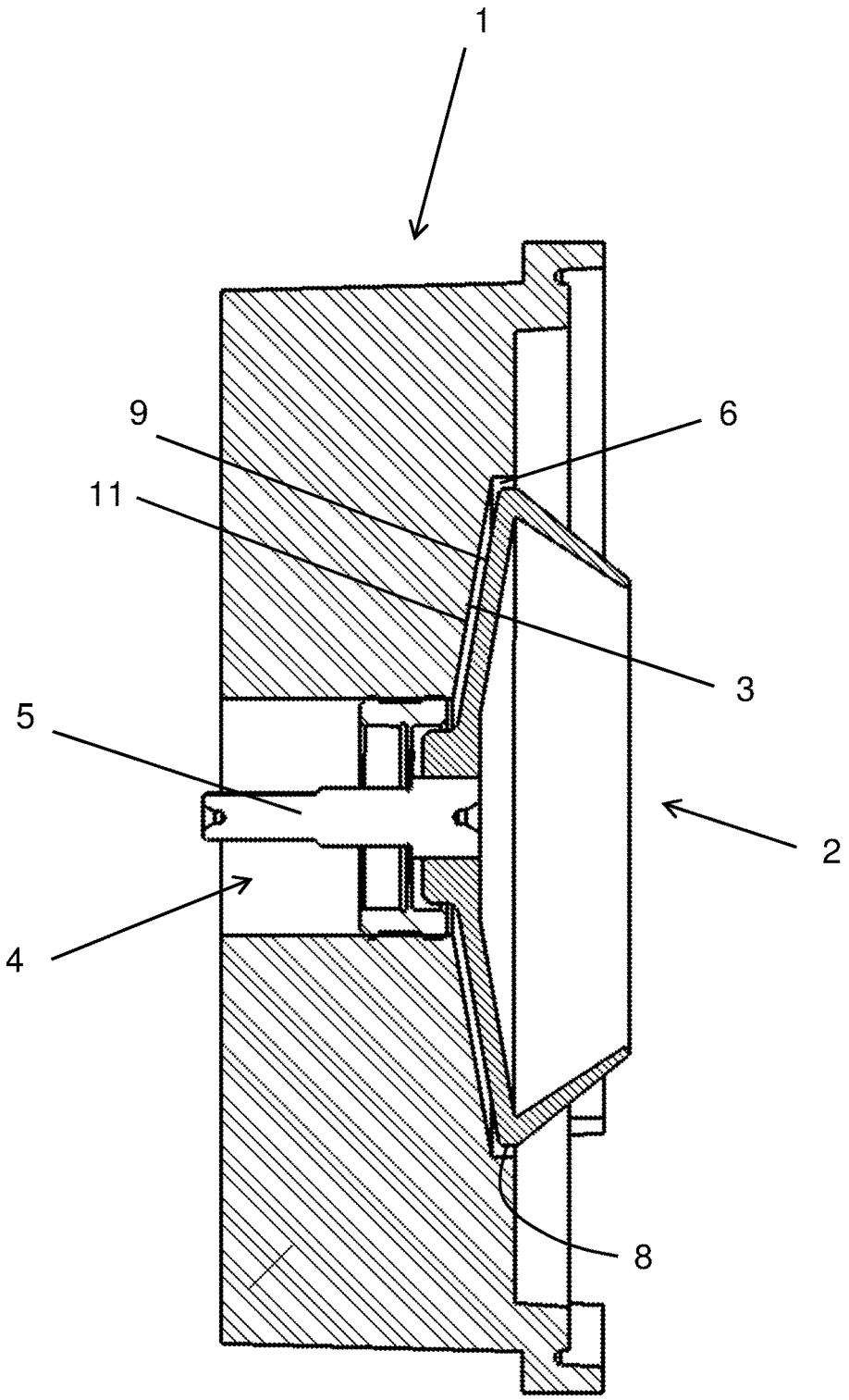
FIG. 3 shows an open-end spinning device according to the present invention without an attachment.

The embodiment shown in FIG. 3 does not have an exchangeable attachment 10. The rotor housing is constructed in one piece. The rear wall 3 of the rotor housing 1 thus corresponds to rear boundary wall 11. Otherwise the shape and construction of the open-end spinning device corresponds to FIG. 2.

Figure 4:
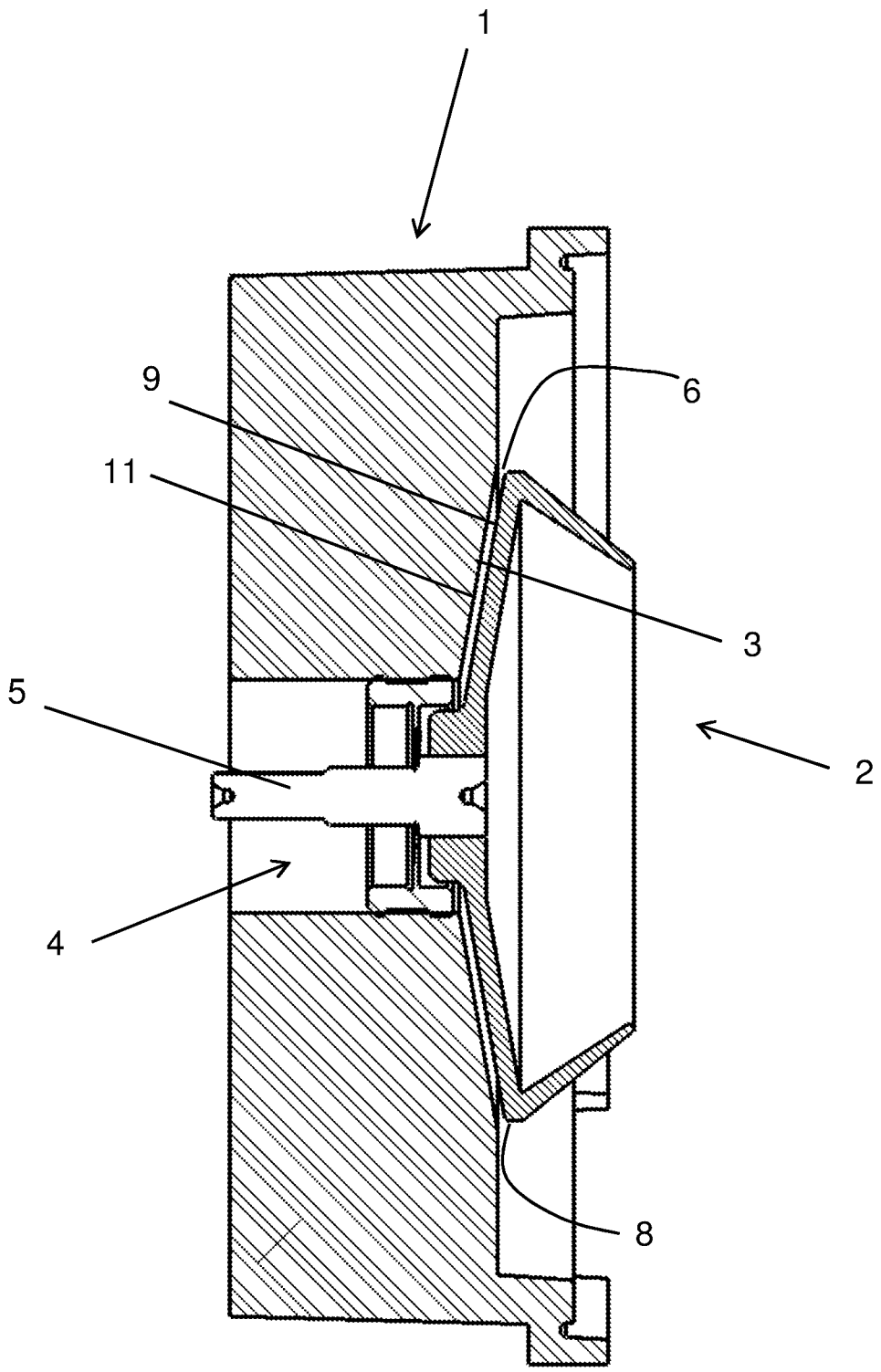
FIG. 4 shows an alternative open-end spinning device according to the present invention without attachment.

FIG. 4 shows a variant without attachment 10. In contrast to the embodiment examples shown previously, the gap 6 at the largest outer diameter of the spinning rotor 3 does not continue along the outer edge 8 of the spinning rotor. However, the rear wall 3 of the rotor housing 1 and the rotor bottom 9 are designed so that the gap 6 continues along the rotor bottom. This embodiment makes it possible to insert 10 spinning rotors 2 with different diameters into the rotor housing 1 even without an exchangeable attachment. The spinning rotors 2 only need to have the same angle of inclination at the rotor bottom 9.

Figure 5:
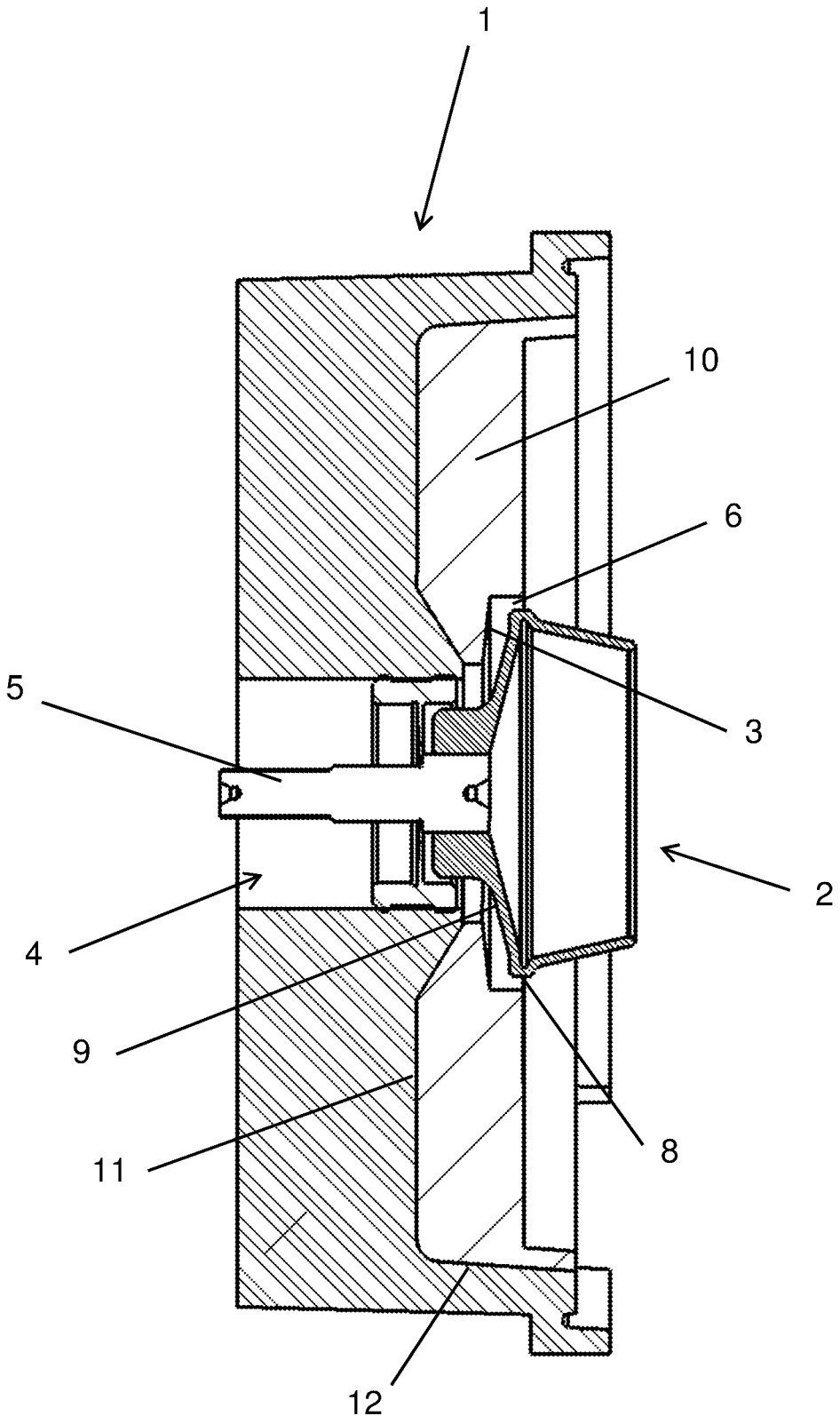
FIG. 5 shows an open-end spinning device according to the present invention with an alternative spinning rotor.

FIG. 5 shows a variant of an open-end spinning device configured according to the present invention, with another spinning rotor 2. In terms of invention, a narrow gap 6 of less than 2 mm gap width between the spinning rotor 2 and the rear wall 3 of the rotor housing 1 is also provided on the largest outer diameter of the spinning rotor 2. As with previous embodiments, the gap 6 also continues along the rotor bottom 9. However, the gap width at the rotor bottom 9 is larger than at the largest outer diameter of the spinning rotor 2. Here again, it is clear that, in the present invention, it is important that the area behind the spinning rotor is shielded or covered. It does not matter that the area behind the spinning rotor 2 is filled by the rotor housing 1.

LIST OF REFERENCE NUMBERS

1 Rotor housing
2 Spinning rotor
3 Rear wall of the rotor housing
4 Passage opening
5 Rotor shaft
6 Gap
7 Area behind the spinning rotor
8 Outer edge of the spinning rotor
9 Rotor bottom
10 Attachment
11 Rear boundary wall
12 Lateral boundary wall
13 Spinning cup
14 Ring-shaped wall section It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. An open-end spinning device comprising a rotor housing which can be acted upon by negative pressure and a spinning rotor, the rotor housing is open towards the front and can be closed by a cover element, to the rear the rotor housing has a rear wall with a passage opening for a rotor shaft of the spinning rotor, characterised in that at the largest outer diameter of the spinning rotor there is a narrow gap of less than 2 mm gap width between the spinning rotor and the rear wall of the rotor housing, and the rear wall of the rotor housing is designed in such a manner that the area behind the spinning rotor is covered inside the rotor housing, and the rear wall of the rotor housing is at least partially formed by an exchangeable attachment which rests on a boundary wall of the rotor housing and the attachment extends to lateral boundary walls of the rotor housing.

2. The open-end spinning device according to claim 1, characterised in that at the largest outer diameter of the spinning rotor there is a narrow gap of less than 2 mm gap width but greater than 0.2 mm gap width between the spinning rotor and the rear wall of the rotor housing.

3. The open-end spinning device according to claim 1, characterised in that the spinning rotor has a rotor bottom facing the rear wall of the rotor housing and the narrow gap continues at least partially along the rotor bottom.

4. The open-end spinning device according to claim 1, characterised in that the spinning rotor has an outer edge on the largest outer diameter and the narrow gap continues axially along the outer edge.

5. The open-end spinning device according to claim 1, characterised in that the attachment forms the narrow gap with the spinning rotor at the largest outer diameter of the spinning rotor.

6. The open-end spinning device according to claim 1, characterised in that the attachment is designed to be conical or cylindrical.

7. The open-end spinning device according to claim 1, characterised in that the attachment is fastened to a boundary wall of the rotor housing by a clip connection, a screw connection, a magnetic force or a press fit.

8. The open-end spinning device according to claim 1, characterized in that the narrow gap possesses a gap width of approximately 1 mm.

* * * * *